US006653793B1

(12) United States Patent
Itokawa et al.

(10) Patent No.: US 6,653,793 B1
(45) Date of Patent: Nov. 25, 2003

(54) PLASMA DISPLAY DEVICE AND METHOD FOR SETTING DRIVE OPERATION

(75) Inventors: Naoki Itokawa, Kawasaki (JP); Yoshiho Seo, Kawasaki (JP); Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/372,171

(22) Filed: Feb. 25, 2003

(30) Foreign Application Priority Data

May 30, 2002 (JP) ..... 2002-156674

(51) Int. Cl.[7] ..... G09G 3/10

(52) U.S. Cl. ..... 315/169.1; 315/169.4; 345/66; 345/63; 345/67; 313/585; 313/584

(58) Field of Search ..... 315/169.1, 169.4, 315/169.3, 169.2; 345/60, 63, 41, 67, 66, 68; 313/582, 584, 585

(56) References Cited

U.S. PATENT DOCUMENTS 6,211,614 B1 * 4/2001 Katayama et al. ..... 313/582
6,317,105 B1 * 11/2001 Eo et al. ..... 345/68
6,414,435 B1 * 7/2002 Akiba ..... 313/584
6,545,423 B2 * 4/2003 Sakita et al. ..... 315/169.3
2001/0033255 A1 * 10/2001 Otsuka et al. ..... 345/60

FOREIGN PATENT DOCUMENTS

JP 2001-242825 9/2001

* cited by examiner

*Primary Examiner*—Haissa Philogene
(74) *Attorney, Agent, or Firm*—Staas & Halsey LLP

(57) ABSTRACT

A plasma display device with improved luminance and light emission efficiency in display discharge without shortening the life is provided. The plasma display panel has a structure including a discharge gas space and fluorescent materials between the display electrode and the address electrode. After the addressing process for forming wall charge in cells to be lighted, a drive operation is performed for changing a potential of at least one display electrode so as to be different between the start time point and the end time point of the display discharge for generating display discharge and the following reform of the wall charge in the cell, and the cell voltage between the display electrode and the address electrode at the start time point of the display discharge is set to a value lower than the microdischarge start voltage that is measured in advance.

4 Claims, 13 Drawing Sheets

PLASMA DISPLAY DEVICE AND METHOD FOR SETTING DRIVE OPERATION

BACKGROUND OF THE INVENTION

1. Field of the Invention

The present invention relates to a plasma display device utilizing a plasma display panel (PDP) for displaying an image and a method for setting operation of a driving circuit that drives the plasma display panel.

A plasma display device is becoming common place as a television set having a large screen. In order to promote making it more popular, it is necessary to improve performances of the plasma display device. Especially, it is an urgent necessity to improve a light emission efficiency that is defined by a ratio of luminance to power consumption, since it is lower than a liquid crystal display device at present.

2. Description of the Prior Art

As a color display device, a surface discharge AC type PDP is known well. The surface discharge type has a three-electrode structure in which first and second display electrodes that become anodes and cathodes in display discharge for determining light emission quantity of a cell are arranged in parallel on one of substrates, and address electrode are arranged on the other substrate so as to cross the display electrode pairs. The display electrode pairs are covered with a dielectric layer, and the address electrodes are opposed to the display electrodes via a discharge gas space. In the surface discharge type, fluorescent material layers for a color display are formed on the substrate on which the address electrodes are arranged so as to be apart from the display electrode pairs in the direction of the panel thickness. By making the fluorescent material layers apart from the display electrode pairs, deterioration of the fluorescent material layers due to the impact of discharge can be reduced.

As known well about a display by the AC type PDP, line sequential addressing is performed for controlling wall voltage of a cell in accordance with display data, and then a sustaining process is performed in which a sustaining voltage pulse train is applied to the cell. The addressing process determines which cells are lighted or unlighted, and the sustaining process determines light emission quantity of each cell. In the above-mentioned three-electrode structure, one of the display electrodes that make a pair and correspond to a row of a matrix display becomes a scan electrode for selecting a row in the addressing process. Address discharge between the scan electrode and the address electrode causes address discharge between the display electrodes, thereby wall charge are formed that is suitable for the sustaining process. In the sustaining process, a drive voltage having an alternating waveform is applied to the display electrode pair for all cells at one time, and display discharge of surface discharge form is generated along the surface of the substrate only in cells having a predetermined wall charge at that time (cells to be lighted).

Concerning a design of a drive voltage waveform for a PDP, Japanese unexamined patent publication No. 2001-242825 has proposed a method for determining a drive voltage for a reset process in which wall charge of a screen is equalized before the addressing process by utilizing a microdischarge start voltage closed curve (hereinafter referred to as a Vt closed curve). In this method, a potential state in a cell of a PDP having a plurality of electrodes is regarded as a point in a space with a coordinate system that is called a cell voltage plane. By measuring the microdischarge start voltage between electrodes of the PDP to be driven and by plotting the voltage in the cell voltage plane, the operating voltage characteristics are illustrated as a Vt closed curve. This illustration makes it easy to find out an optimal voltage condition in a real drive waveform. The cell voltage to be a coordinate axis of the cell voltage plane is defined by the sum of the voltage applied between electrodes by the driving circuit and a potential difference between electrodes (wall voltage) generated by the wall charge in a cell. In the case of the three-electrode structure, two of three interelectrodes are selected, and the cell voltage plane is defined by making each of cell voltage be a coordinate axis.

FIG. 14 shows a usual drive waveform in a conventional method for display discharge that is applied to a three-electrode structure. In the conventional driving method, a sustain pulse having a simple rectangular waveform of amplitude Vs is applied to the first display electrode and the second display electrode alternately during the display period. In other words, the first and the second display electrodes are biased to the potential −Vs temporarily and alternately. The address electrode is not biased. By this potential control, a drive voltage signal of a pulse train having alternating polarities is applied between the first display electrode and the second display electrode (i.e., to the XY-interelectrode). A voltage corresponding to a bias of the display electrode is applied between the first display electrode and the address electrode (i.e., to the XA-interelectrode) and between the address electrode and the second display electrode (i.e., to the AY-interelectrode). Responding to the application of the first sustain pulse to all cells, display discharge is generated in cells in which a predetermined wall charge has been formed in the previous addressing process. When the discharge is generated, the wall charge on the dielectric layer is erased, and soon reformation of wall charge starts. The polarity of the wall charge to be reformed is the opposite to the previous one. As the wall charge is reformed, the cell voltage at the XY-interelectrode drops so that the display discharge ends. The end of the discharge means that discharge current flowing through the display electrode becomes substantially zero. When the second sustain pulse is applied, display discharge is generated again since the polarity of the drive voltage is the same as the polarity of the wall voltage at that time point, and the cell voltage increases when the wall voltage is added to the drive voltage. After that, display discharge is generated similarly every application of the sustain pulse.

The pulse base potential is not necessarily the ground potential (GND). The polarity of the sustain pulse can be positive without being limited to the illustrated negative polarity. In addition, it is possible to apply a drive voltage signal similar to the illustrated one to the XY-interelectrode by applying a pulse having the amplitude Vs' to one of the display electrodes and simultaneously applying a pulse having the amplitude —(Vs–Vs') to the other display electrode.

FIG. 15 shows a cell voltage plane of a display process according to the conventional driving method. According to the cell voltage plane, a state transition of a cell can be understood. In FIG. 15, cell voltage Vc(XA) of the XA-interelectrode is assigned to the horizontal axis, and cell voltage Vc(AY) of the AY-interelectrode is assigned to the vertical axis. The states [1], [1'], [2], [3], [3'] and [4] shown with circles (○) in FIG. 15 correspond to time points t[1], t[1'], t[2], t[3], t[3'] and t[4] shown in FIG. 14, respectively.

When the second display electrode is biased to a negative potential, display discharge is generated with the first display electrode being an anode. After this display discharge finished, the application of the drive voltage (Vs) to the XY-interelectrode still continues during the period till the trailing edge of the pulse. Therefore, the space charge is attracted in electrostatic manner by the dielectric layer to be wall charge. This electrification phenomenon continues until the cell voltage Vc(XY) at the XY-interelectrode becomes zero. The wall voltage Vw(XY) at the XY-interelectrode at the end of the electrification phenomenon is −Vs. The state transition is performed from this state as following (1)–(4).

(1) In the state [1], the formation of the wall charge by the electrostatic attraction of the space charge is finished, the drive voltage is canceled by the wall voltage Vw(XY), and the cell voltage Vc(XY) at the XY-interelectrode is zero. In addition, the cell voltage Vc(XA) at the XA-interelectrode and the cell voltage Vc(AY) at the AY-interelectrode are also zero. When the bias of the second display electrode is finished, the cell voltage Vc(AY) is changed from zero to the value of the wall voltage Vw(AY). In the state [1'], the cell voltage Vc(AY) is −Vs.

(2) Next, when the first display electrode is biased to a negative potential, the cell voltage Vc(XA) at the XA-interelectrode changes. In the state [2], Vc(XA)=−Vs, and Vc(AY)=−Vs. Responding to the transition from the state [1'] to the state [2], display discharge is generated with the second display electrode being an anode.

(3) By the display discharge and the electrostatic attraction of the space charge, the wall voltage Vw(XA) becomes Vs. In the state [3], Vc(XA)=0, and Vc(AY)=0. When the bias of the first display electrode is finished, the cell voltage Vc(XA) becomes a value of the wall voltage Vw(XA), and the cell voltage Vc(AY) becomes a value of the wall voltage Vw(AY). In the state [3'], Vc(XA)=Vs, and Vc(AY)=0.

(4) When the second display electrode is biased again, the cell voltage Vc(AY) at the AY-interelectrode changes. In the state [4], Vc(XA)=Vs, and Vc(AY)=Vs. Responding to the transition from the state [3'] to the state [4], display discharge is generated again with the first display electrode being an anode. After that, the state [4] goes back to the state [1], and the above explained state transition is repeated.

As mentioned above, in the conventional driving method in which a sustain pulse having a simple rectangular waveform is applied, there is a relationship of Vc(XA)=Vc(AY) concerning the cell voltage at the XA-interelectrode and the cell voltage at the AY-interelectrode at the moment when the display discharge is generated as shown in the state [2] and the state [4]. This relationship is fixedly satisfied when the pulse amplitude (Vs) is set to any value within an allowance range for optimizing the drive condition. In other words, the state [2] and the state [4] are always on the line that passes the origin (the intersection of both axes) and has the slope one in the cell voltage plane. The dependency of the luminance and the light emission efficiency on the drive voltage in the conventional driving method is shown in FIG. 16. The drive voltage here is the sustain voltage (Vs) that is applied to the XY-interelectrode for display discharge, and the light emission efficiency is light emission quantity [lm] per unit power consumption (W). As show in FIG. 16, there is a problem in the conventional method, which is that the light emission efficiency is dropped when making the luminance increase.

SUMMARY OF THE INVENTION

An object of the present invention is to improve luminance and light emission efficiency in display discharge, and to prevent a display life from being shortened.

According to one aspect of the present invention, after an addressing process for forming wall charge in cells to be lighted, in order to generate display discharge and the following reform of wall charge in the cells to be lighted, a potential of at least one display electrode in one cell is changed so as to be different between the start time point and the end time point of display discharge, and the cell voltage between the display electrode and the address electrode at the start time point of the display discharge is set to a voltage lower than a microdischarge start voltage that is measured in advance. The change of the potential of the display electrode corresponds to application of a voltage signal whose waveform is not a simple rectangular shape to the display interelectrode. By changing the drive voltage that is applied to the interelectrode, a choice of setting the cell state concerning the display discharge can be made among various options, and luminance and light emission efficiency can be improved. By setting the cell voltage between the display electrode and the address electrode to a voltage lower than the microdischarge start voltage, discharge between the display electrode and the address electrode, which causes deterioration of the fluorescent material, is not generated, so sufficient display life can be obtained.

In addition, the present invention utilizes a method of measuring a Vt closed curve by defining a cell voltage plane for setting the drive operation of the sustaining process that generates display discharge. Thus, efforts of designing job for optimizing the operational condition can be reduced.

DESCRIPTION OF THE PREFERRED EMBODIMENTS

Hereinafter, the present invention will be explained more in detail with reference to embodiments and drawings.

Figure 1:
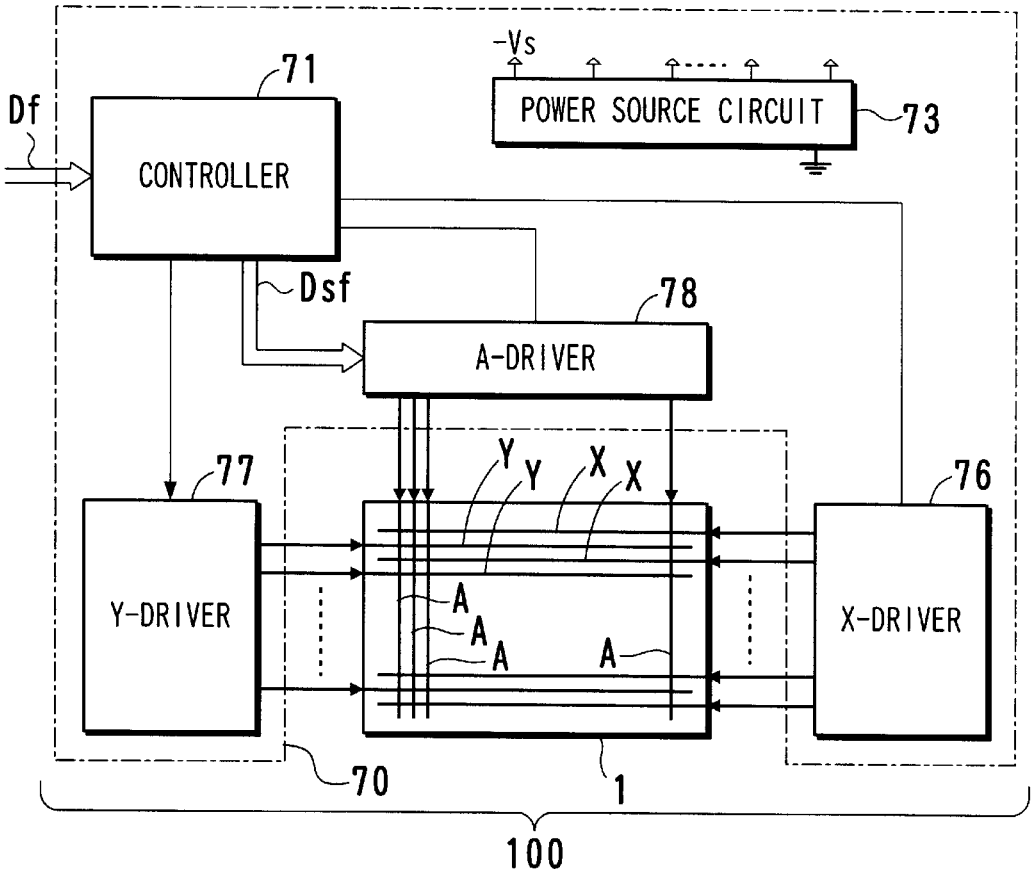
FIG. 1 is a block diagram of a plasma display device according to the present invention.

FIG. 1 is a block diagram of a plasma display device according to the present invention. The plasma display device 100 comprises a PDP 1 having a three-electrode structure and a 32-inch color display screen and a drive unit 70 for controlling light emission of cells. The plasma display device 100 is used as a wall-hung television set, a monitor of a computer system or others.

The PDP 1 comprises a pair of substrate structures. The substrate structure means a structural body including an electrode and other constituting elements arranged on a glass substrate. In the PDP 1, display electrodes X and Y that constitute an electrode pair for generating display discharge are arranged in the same direction, and address electrodes A are arranged so as to cross the display electrodes X and Y. The display electrodes X and Y extend in the row direction of a screen (i.e., in the horizontal direction) and are covered with a dielectric layer and a protection film. The display electrode Y is used as a scan electrode. The address electrodes A extend in the column direction (i.e., in the vertical direction). The address electrode A is used as a data electrode. The row means a set of cells having the same arrangement order in the column direction, while the column is a set of cells having the same arrangement order in the row direction.

The drive unit 70 includes a controller 71, a power source circuit 73, an X-driver 76, a Y-driver 77 and an A-driver 78. The drive unit 70 is supplied with frame data Df indicating luminance levels of red, green and blue colors together with various synchronizing signals from an external device such as a TV tuner or a computer. The frame data Df is memorized in a frame memory of the controller 71 temporarily. The controller 71 converts the frame data Df into subframe data Dsf for a gradation display and transmits the subframe data Dsf to the A-driver 78. The subframe data Dsf is a set of display data whose one bit corresponds to one cell. A value of each bit indicates whether a cell of the corresponding subframe is to be lighted or not, more specifically whether address discharge is necessary or not. Furthermore, in the case of an interlace display, a frame is made of a plurality of fields, and each of the fields is made of a plurality of subfields. Therefore, the light emission control is performed for each subfield. However, the light emission control itself is similar to the case of a progressive display.

Each of the X-driver 76, the Y-driver 77 and the A-driver 78 includes a switching device for applying a pulse to electrodes, and opens or closes a conductive path between the bias power source line corresponding to pulse amplitude and the electrode in accordance with an instruction from the controller 71.

Figure 2:
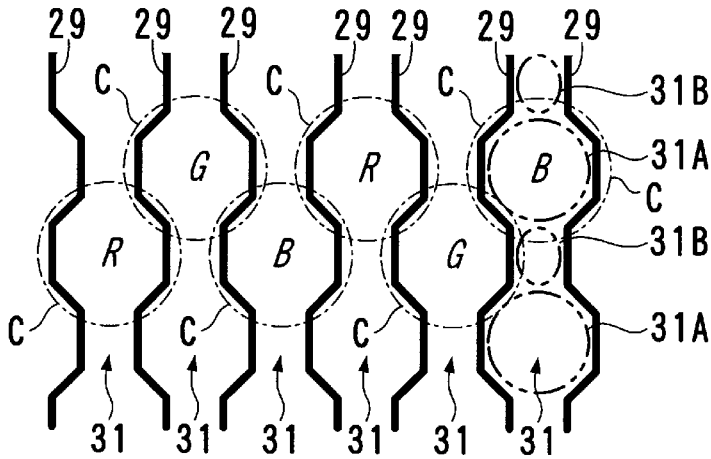
FIG. 2 is a plan view showing a cell arrangement of a display screen.

FIG. 2 is a plan view showing a cell arrangement of the display screen.

In the display screen, a discharge space is divided into columns by partitions 29 meandering regularly, so that a column space 31 is formed in which wide portions (portions having a large width in the row direction) 31A and narrow portions (portions having a small width) 31B are arranged alternately. In other words, each of the partitions 29 meanders in a plan view at a constant period and at a constant width, and the partitions 29 are arranged so that the distance between the neighboring partitions 29 is smaller than a constant value every position arranged at a constant pitch in the column direction. The constant value means a size that can suppress discharge and depends on discharge conditions such as a gas pressure. The structure of the column space 31 defined by neighboring two partitions and being continuous over all rows has an advantage in easy driving by priming for each column, uniform thickness of fluorescent material layers and an easy exhausting process in a manufacturing process. Since surface discharge is hardly generated in the narrow portion 31B, the wide portion 31A contributes to the light emission substantially. Namely, each cell C is a structural body within one wide portion 31A in a display screen. The cells are disposed every other column in each row. Noting neighboring two rows, the column having a cell is switched alternately every column. In other words, the cells are arranged in a zigzag pattern both in the row direction and in the column direction. In FIG. 2, six cells C are shown as representatives in dot-dashed circles (the circles enclose a little larger areas than real areas for better view of the diagram). In the PDP 1, one pixel is made of total three cells that are red, green and blue cells, and the arrangement form of three colors of the color display is triangular (delta) arrangement form. The triangular arrangement can make the width of a cell in the row direction larger than a third of the pixel pitch and is advantageous in high definition compared with the inline arrangement. Moreover, since the ratio of non-light emission area to the entire screen is small, a high luminance display can be performed. The row direction is not necessarily the horizontal direction, but it can be the vertical direction and the column direction can be the horizontal direction.

Figure 3:
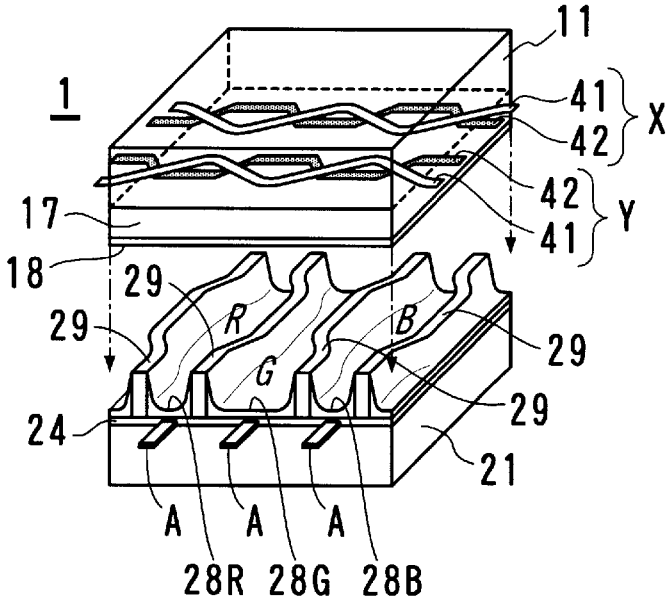
FIG. 3 is a perspective view showing a cell structure of a PDP.

FIG. 3 is a perspective view showing a cell structure of the PDP.

In the PDP 1, the display electrodes X and Y, the dielectric layer 17 and the protection film 18 are arranged on the inner surface of the glass substrate 11 of the front substrate structure 10, and the address electrodes A, an insulator layer 24, the partitions 29 and the fluorescent material layers 28R, 28G and 28B are arranged on the inner surface of the glass substrate 21 of the back substrate structure 20. The display electrodes X and Y are arranged alternately at a constant gap (a surface discharge gap) in the column direction. The gap direction of the surface discharge gap, i.e., the opposing direction of the display electrodes X and Y is the column direction.

Figure 4:
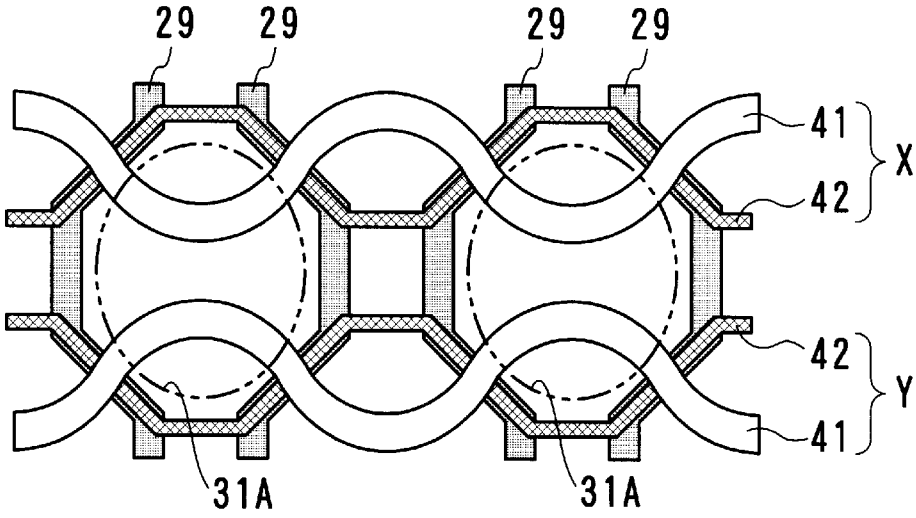
FIG. 4 is a plan view showing a shape of a display electrode.

FIG. 4 is a plan view showing a shape of the display electrode.

Each of the display electrodes X and Y is made of a transparent conductive film 41 that extends in the row direction meandering in the column direction and a bandlike metal film 42 that extends in the row direction meandering along the partitions 29 so as to avoid the wide portions 31A. The transparent conductive film 41 has a band-like shape that is curving like a wave and has arc gap forming portions protruding from the metal film 42 to the wide portions 31A for each column. In each of the wide portions 31A, the gap forming portion of the display electrode X and the gap forming portion of the display electrode Y are opposed to each other, so that a drum-like surface discharge gap is formed. In a pair of opposed gap forming portions, the opposed sides are not parallel. The width of the band-like transparent conductive film 41 can vary regularly. According to this electrode shape, capacitance of the interelectrode distance can be reduced without increasing surface discharge gap length (the shortest distance between electrodes) compared with the case of the linear band-like shape. In addition, since the distance between the transparent conductive film 41 and the metal film 42 at the middle of the wide portion 31A in the row direction is large, intensity of electric field that is generated at the gap between the transparent conductive film 41 and the metal film 42 is small. This contributes to prevention of discharge interference between rows. In addition, as a second effect, light shield effect by the metal film 42 is reduced so that the light emission efficiency is increased.

Figure 5:
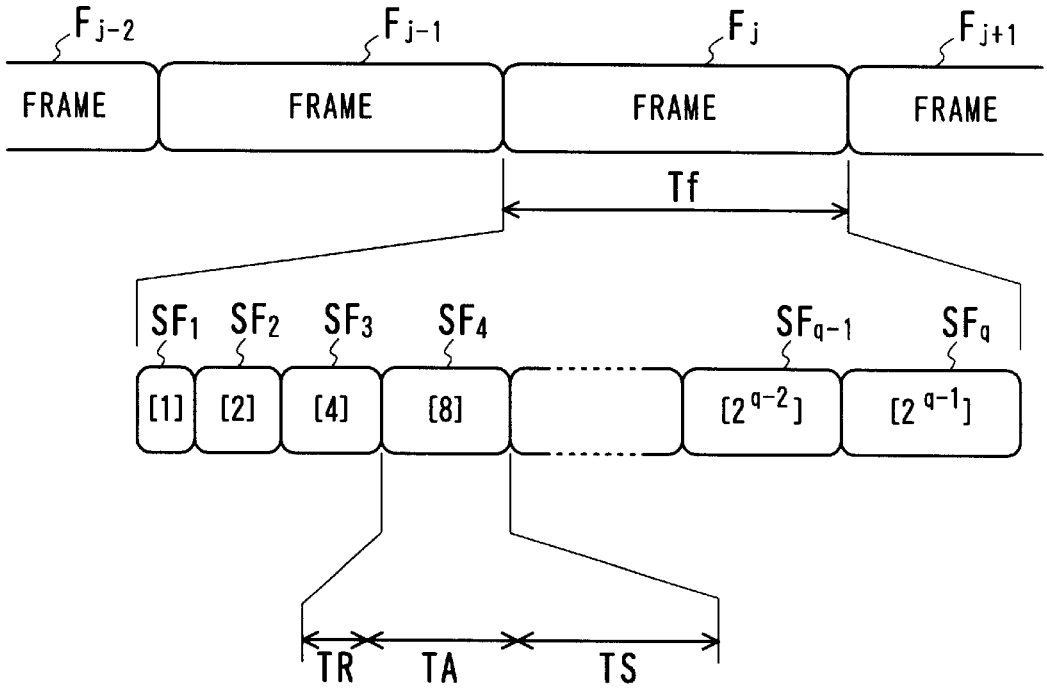
FIG. 5 is a diagram showing a concept of frame division.

FIG. 5 is a diagram showing a concept of frame division. In a display using the PDP 1, color reproduction is performed by a binary control of lighting. Therefore, each of time sequential frames F that constitute an input image is divided into a predetermined number q of subframes SF. In other words, each frame F is replaced with a set of q subframes SF. Weights such as $2^0$, $2^1$, $2^2$, . . . , $2^{q-1}$ are assigned to these subframes SF sequentially so as to set the number of display discharge times in each subframe SF. In FIG. 5, the weight order is the subframe arrangement order, but it can be other order. A redundant weighting can be adopted for reducing a quasi-contour. In accordance with this frame structure, a frame period Tf that is a frame transmission period is divided into q subframe periods, and one subframe period is assigned to each subframe SF. Furthermore, the subframe period is divided into a reset period TR for initialization, an address period TA for addressing and a display period TS for sustaining. The lengths of the reset period TR and the address period TA are constant regardless of the weight, while the length of the display period TS is longer as the weight is larger. Therefore, the length of the subframe period is longer as the weight of the corresponding subframe SF is larger. The driving sequence is repeated every subframe, and the order of the reset period TR, the address period TA and the display period TS is the same for q subframes SF. Hereinafter, drive waveforms in the display period TS related to a feature of the present invention will be explained.

Figure 6:
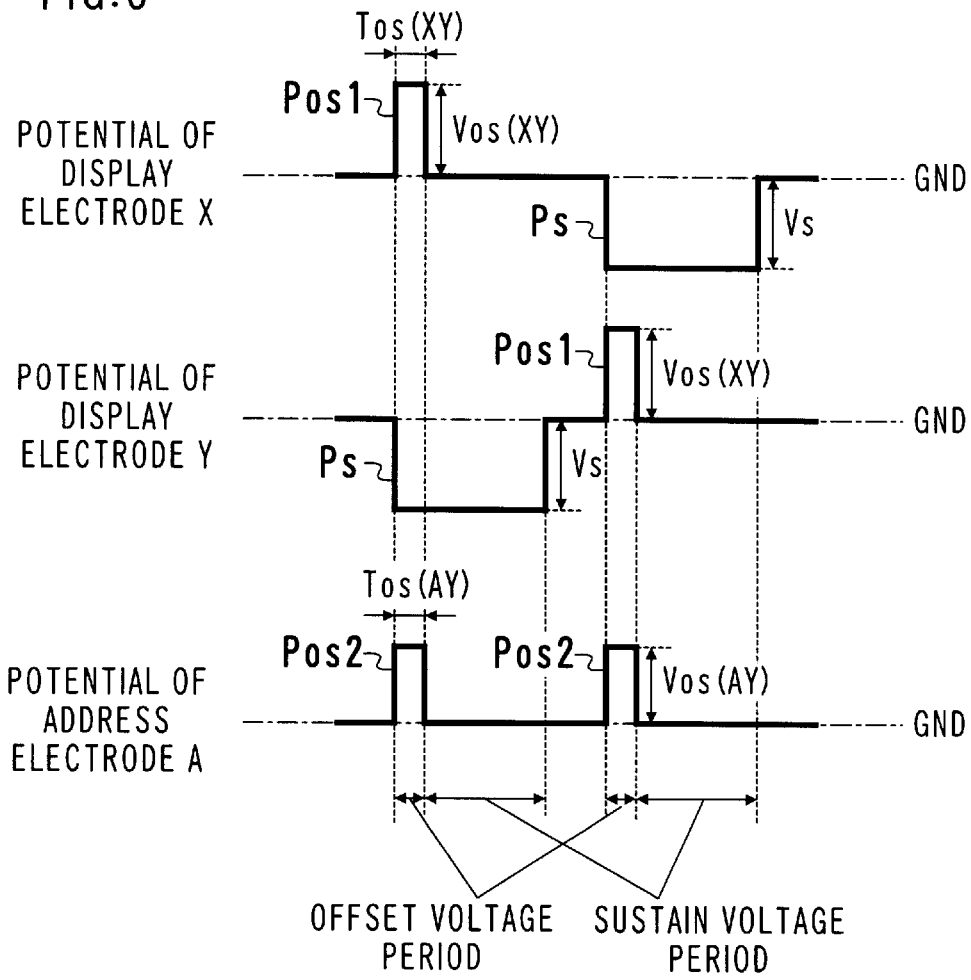
FIG. 6 is a diagram showing waveforms of drive voltage signals in a display period.
Figure 7:
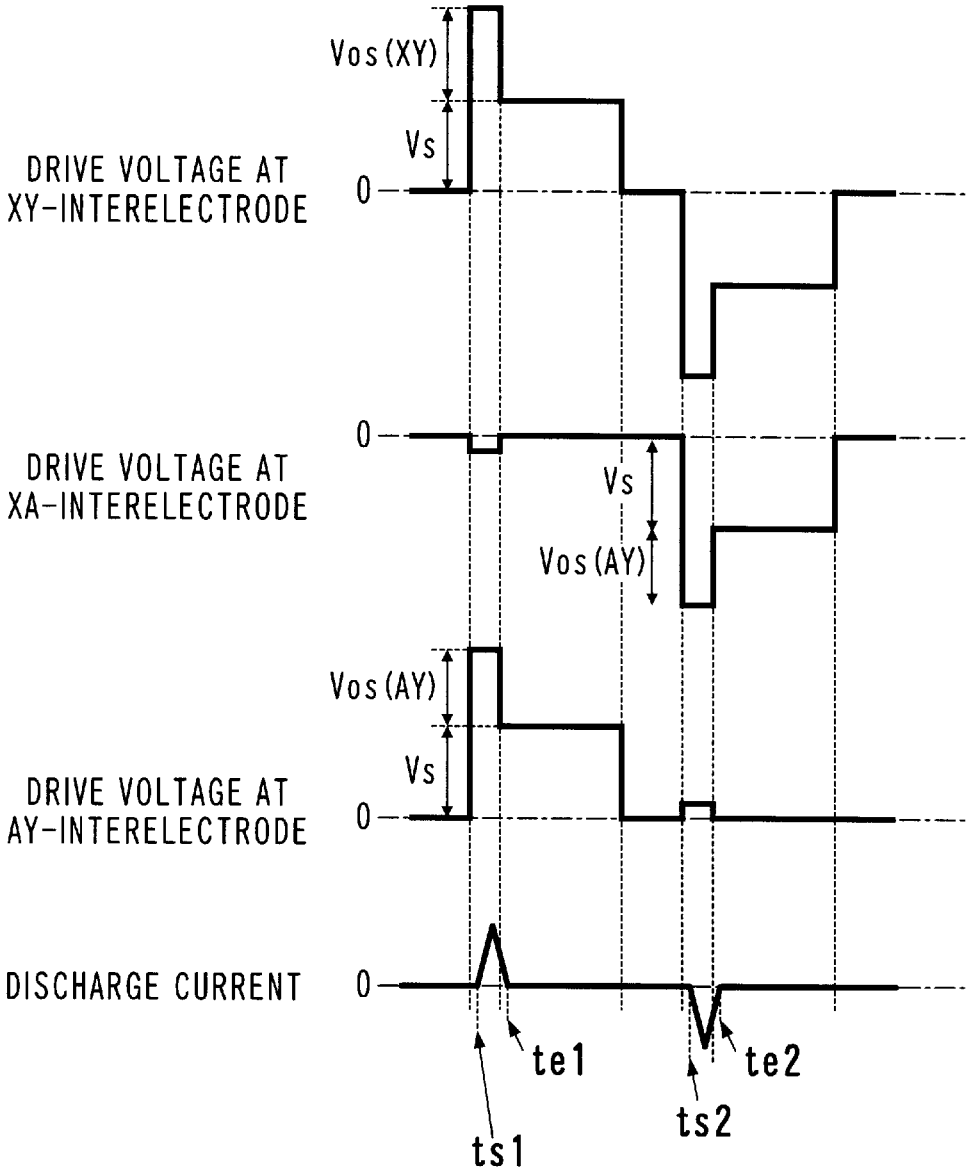
FIG. 7 is a diagram showing the relationship between changes of drive voltages and discharge.

FIG. 6 is a diagram showing waveforms of drive voltage signals in the display period. FIG. 7 is a diagram showing the relationship between changes of drive voltages and discharge. In FIGS. 6 and 7, the drive voltage signals of two times of display discharge are illustrated. In a subframe that generates display discharge three times or more, the illustrated drive voltage signals are applied to the electrodes repeatedly. The drive voltage signal that is applied to the interelectrode is a composite signal of the drive voltage signals for each of the corresponding electrodes.

As shown in FIG. 6, a drive voltage signal including a sustain pulse Ps and an offset pulse Pos1 is applied to the display electrode X and the display electrode Y, and a drive voltage signal including an offset pulse Pos2 is applied to the address electrode A. The sustain pulse Ps is applied to the display electrode X and the display electrode Y alternately, and display discharge is generated on each application. This is because that the amplitude Vs of the sustain pulse Ps is set so that the cell voltage at the XY-interelectrode exceeds the discharge start voltage when the sustain pulse Ps is added even if the amplitude Vos(XY) of the offset pulse Pos1 is zero. When the sustain pulse Ps is applied to one of the display electrodes X and Y, the offset pulse Pos1 is applied to the other display electrode. The pulse width Tos(XY) of the offset pulse Pos1 is set to a value substantially shorter than the pulse width of the sustain pulse Ps (approximately a few microseconds) so that the drive voltage at the XY-interelectrode is different between the start time point ts1 or ts2 and the end time point te1 or te2 of display discharge as shown in FIG. 7, i.e., so that the application of the offset pulse Pos1 finishes during the display discharge, and the drive voltage changes from Vs+Vos(XY) to Vs. More specifically, the pulse width Tos(XY) is set to a value within a range of 100–200 nanoseconds. The offset pulse Pos2 is applied to the address electrode A when the sustain pulse Ps is applied to the display electrode X and the display electrode Y. When the application of the offset pulse Pos2 is finished, the drive voltage for the AY-interelectrode or the XA-interelectrode changes from Vs+Vos(AY) to Vs during the display discharge. The pulse width Tos(AY) of the offset pulse Pos2 is also substantially shorter than the pulse width of the sustain pulse Ps (a specific value is the same as the offset pulse Pos1).

Figure 14:
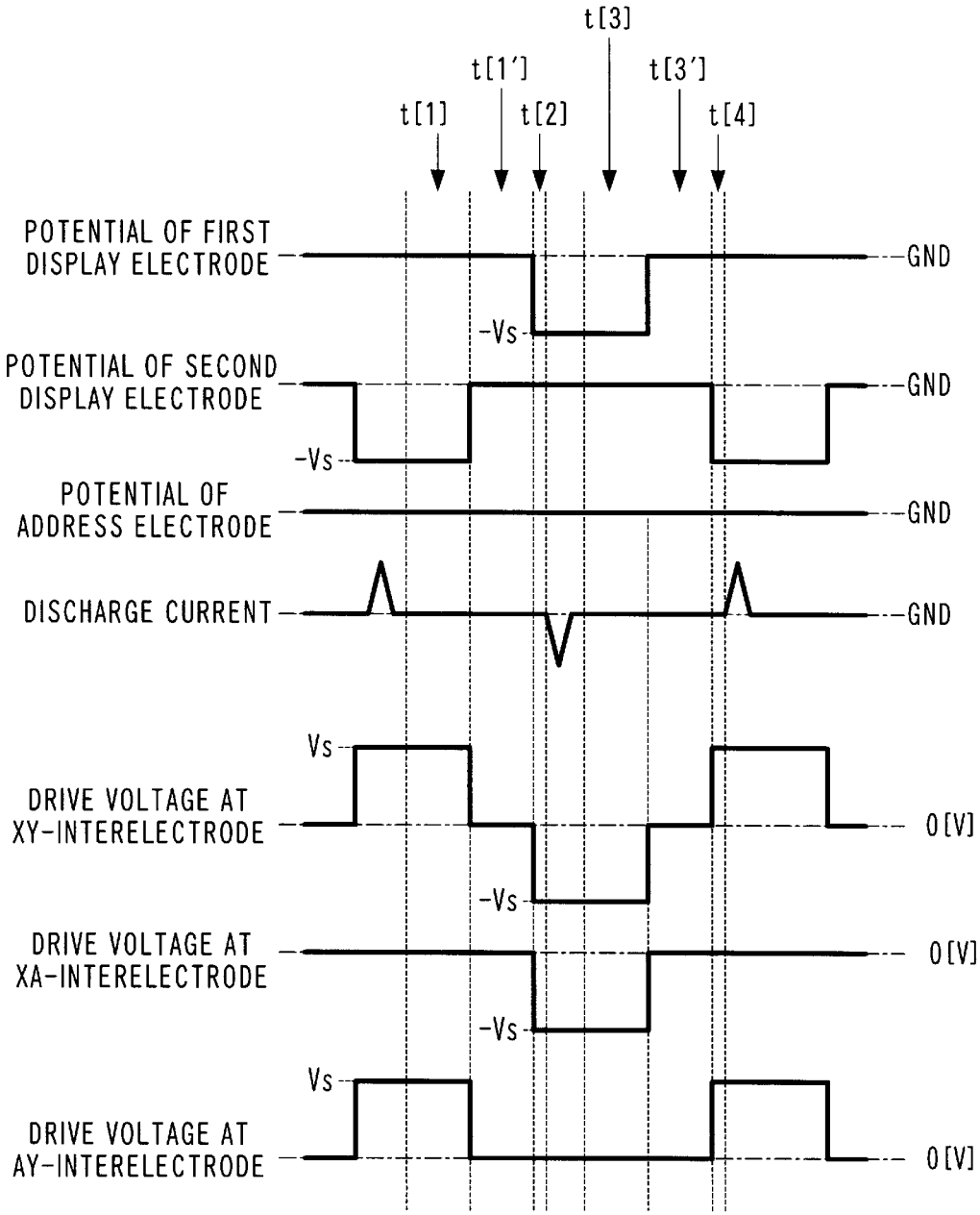
FIG.14 PRIOR ART
FIG. 14 is conventional normal drive waveforms for display discharge that are applied to a three-electrode structure.
Figure 15:
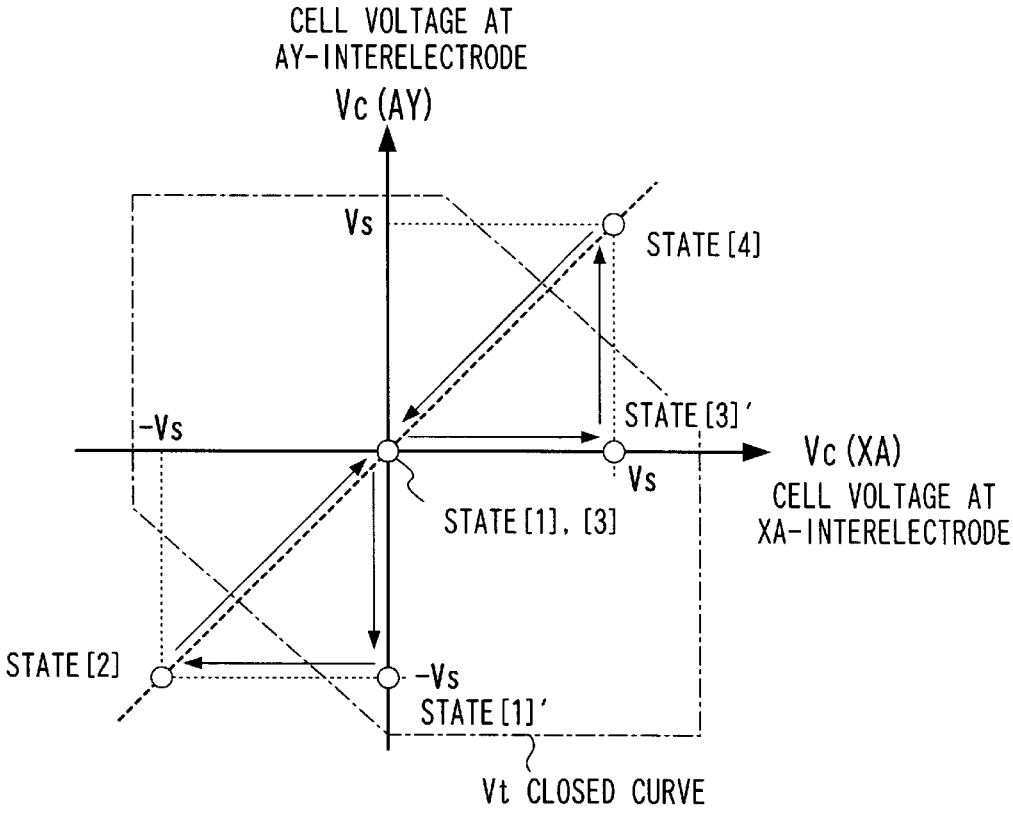
FIG.15 PRIOR ART
FIG. 15 is a diagram of a cell voltage plane showing a display process according to the conventional driving method.
Figure 16:
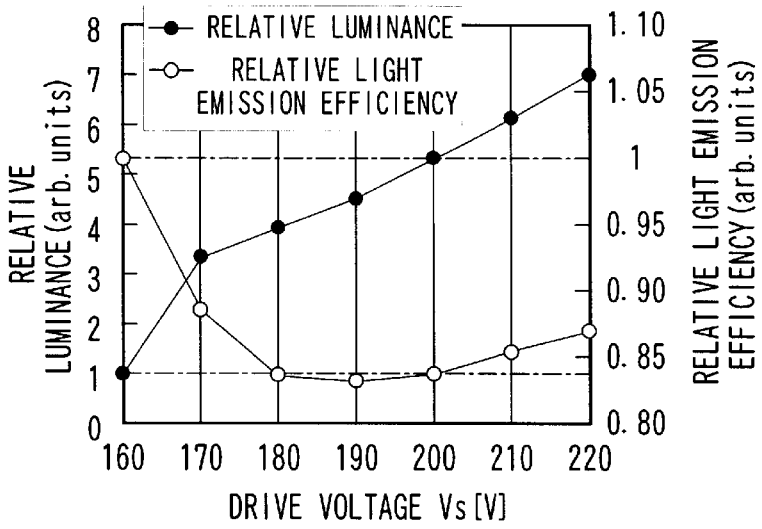
FIG.16 PRIOR ART
FIG. 16 is a graph showing dependency of luminance and light emission efficiency on a drive voltage in the conventional method.

This driving form in which the offset pulse Pos1 or Pos2 is added to the sustain pulse Ps is called an offset drive, while the conventional driving form without adding the offset pulse as shown in FIG. 14 is called a normal drive. In the offset drive, similarly to the normal drive, the reform of wall charge mainly depends on the applied voltage after the display discharge is finished. Therefore, even if the discharge intensity is increased by adding the offset pulse Pos1 or Pos2, the state of the reformed wall charge can be made an appropriate state that enables display discharge to be generated repeatedly.

Figure 8:
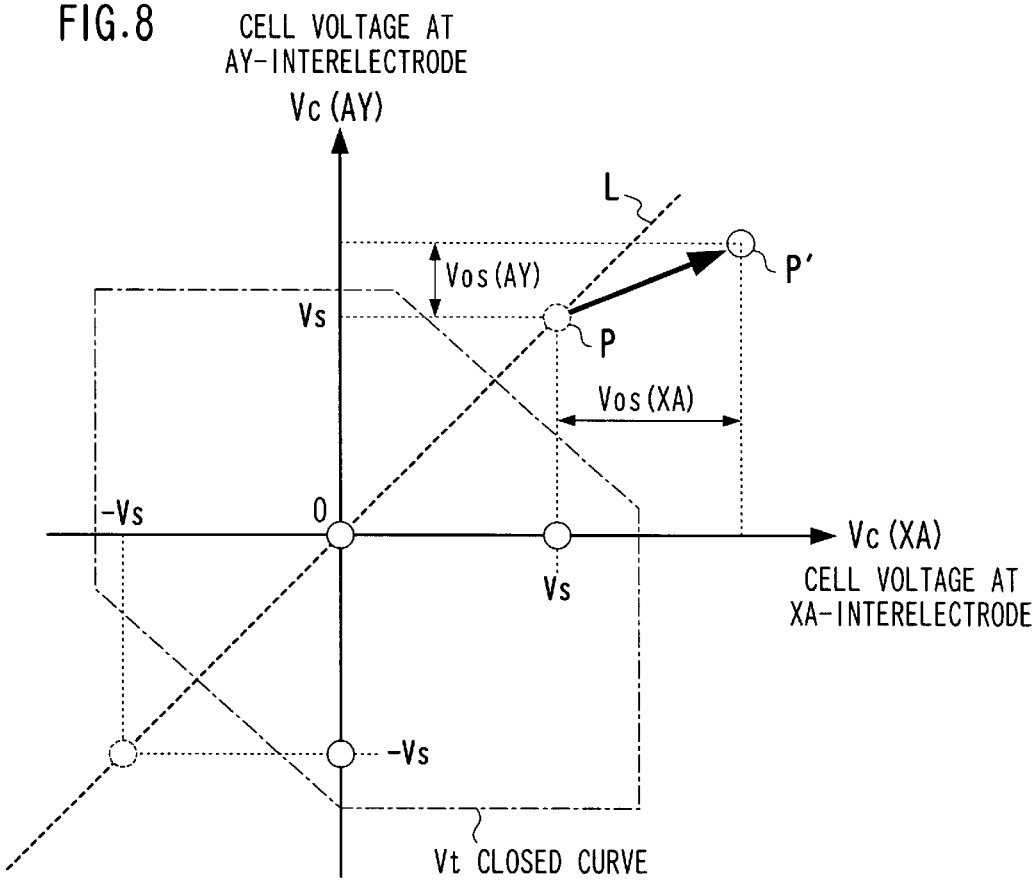
FIG. 8 is a diagram of a cell voltage plane showing a display process according to the present invention.

FIG. 8 shows a cell voltage plane of a display process according to the present invention. The following explanation is about display discharge in which the display electrode X works as an anode and the display electrode Y works as a cathode for a type since the display electrodes X and Y are arranged symmetrically in a cell, and the functions of the display electrodes X and Y are the same concerning display discharge.

When the offset pulse Pos1 is added to the sustain pulse Ps, the cell voltage at the discharge start time point moves in the direction along the horizontal axis as shown in FIG. 8. Furthermore, when the offset pulse Pos2 is added to the sustain pulse Ps, the cell voltage at the discharge start time point moves in the direction along the vertical axis as shown in FIG. 8. Namely, when the offset pulse Pos1 and the offset pulse Pos2 are applied, a two-dimensional movement from the point P to the point P' is achieved in the cell voltage plane. This means that the relationship between the cell voltage at the XA-interelectrode and the cell voltage at the AY-interelectrode at the moment when display discharge is generated can be set freely. In the cell voltage plane, the position indicating a cell state at the discharge start time point (shown by a circle in FIG. 8) is not limited to be on the line that passes the origin and has the slope one. Here, a movement of the point P is regarded as a vector and is called an offset vector. When components of the offset vector, i.e., amplitude of the offset pulse Pos1 (an offset voltage) Vos (XY) and amplitude of the offset pulse Pos2 (an offset voltage) Vos(AY) are determined appropriately, luminance and light emission efficiency are improved.

Figure 9:
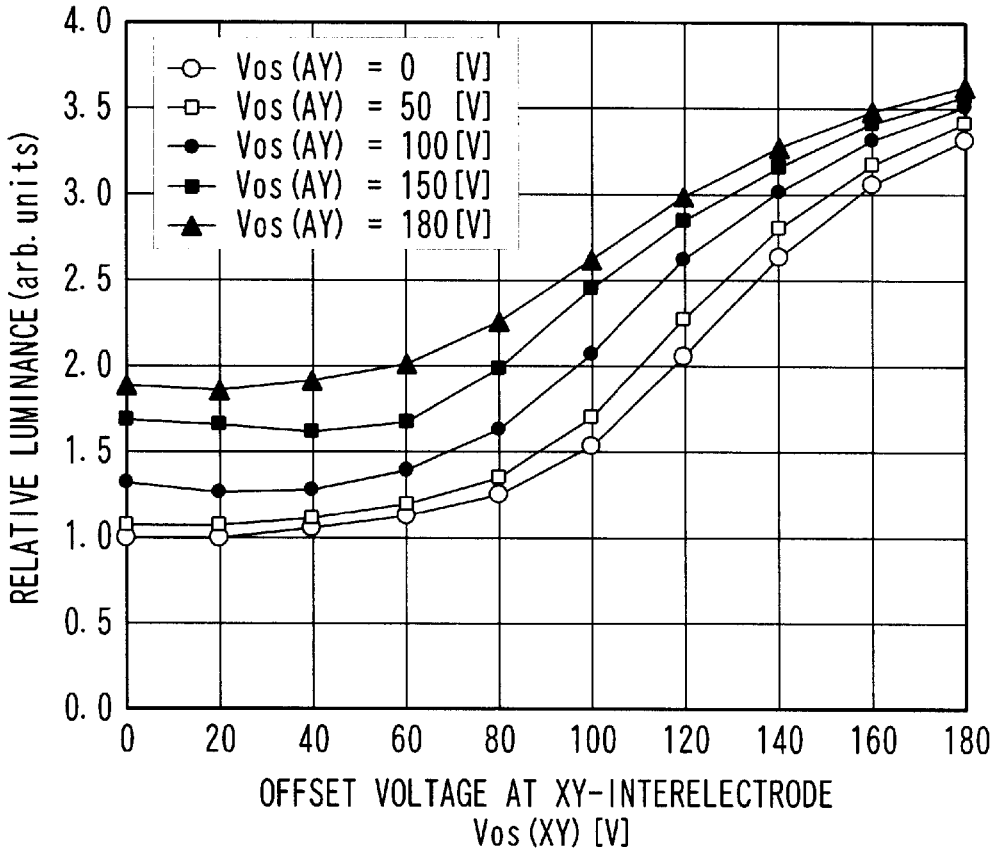
FIG. 9 is a graph showing dependency of luminance on an offset voltage.
Figure 10:
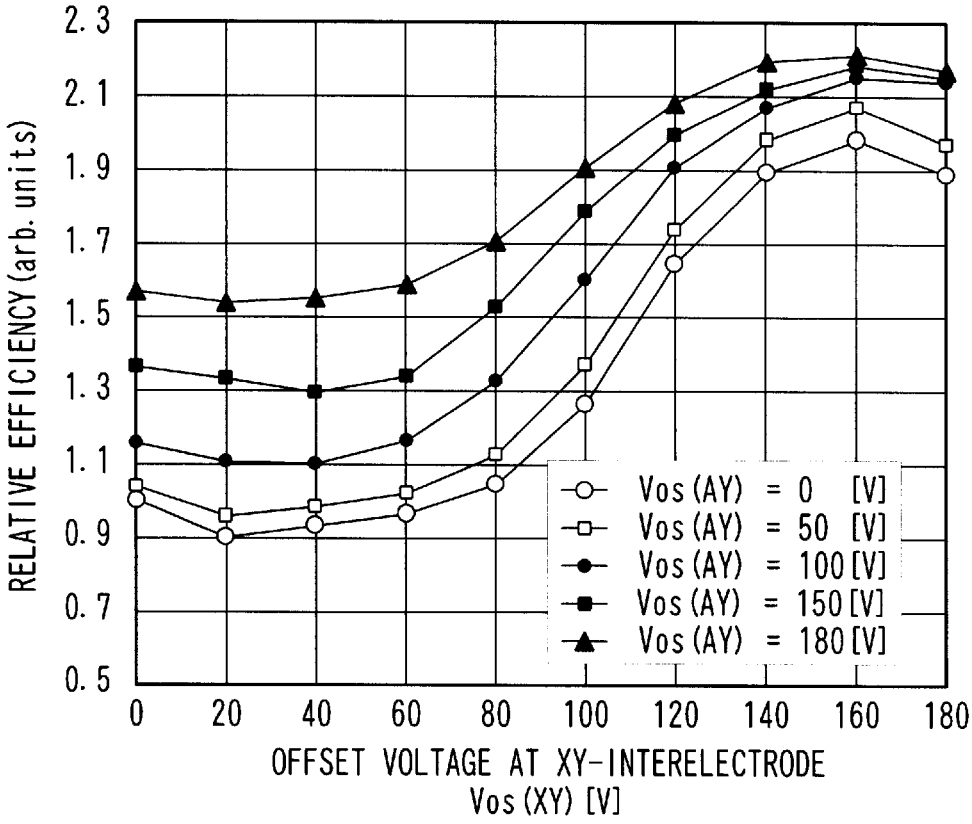
FIG. 10 is a graph showing dependency of light emission efficiency on the offset voltage.

FIG. 9 shows dependency of luminance on the offset voltage, and FIG. 10 shows dependency of light emission efficiency on the offset voltage. FIGS. 9 and 10 show results of the measuring experiment in which the PDP 1 is driven under the condition that the amplitude Vs of the sustain pulse Ps is set to 180 volts that is the medium value of the allowance range in the waveform shown in FIG. 6 and that the offset voltage Vos(XY) and the offset voltage Vos(AY) are parameters.

The curve of Vos(AY)=0 volt indicates a characteristic when the cell voltage is moved only in the direction along the horizontal axis in FIG. 8. In contrast, if the cell voltage is moved in the directions along the horizontal axis and along the vertical axis by adding the offset voltage Vos(XY) and the offset voltage Vos(AY), both luminance and light emission efficiency are high under any condition of Vos (AY)=50 volts, Vos(AY)=100 volts, Vos(AY)=150 volts or Vos(AY)=180 volts. In addition, the dependency of the light emission efficiency on the offset voltage Vos(XY) has an acute peak when Vos(AY)=0 volt, while it becomes smooth dependency characteristic as the offset voltage Vos(AY)

increases. If the characteristic curve is smooth, a margin (the allowance range) for setting the drive voltage is large. In other words, even if the offset voltage Vos(XY) is varied, the change of the characteristic due to the variation is little, so it is easy to secure the display quality at a predetermined level. If the characteristic curve is acute, the display quality may be changed largely when the offset voltage Vos(XY) is varied a little. Therefore, the method of adding the offset voltage Vos(AY) is advantageous not only in display characteristics but also in drive control. In addition, if Vos (AY)=0 volt, the offset voltage Vos(XY) should be 160 volts for maximizing the light emission efficiency. In contrast, if the offset voltage Vos(AY) is added, it is sufficient that Vos(AY)=100 volts, and Vos(XY)=130 volts. The method of adding the offset voltage Vos(AY) also contributes to reduction of a withstand voltage of the driving circuit and reduction of power source voltage.

As understood from characteristics shown in FIGS. 9 and 10, luminance and light emission efficiency can be improved when the offset voltage Vos(AY) has a value within the range of 50–180 volts as explained above. However, a preferable range of the offset voltage Vos(AY), which may cause an outstanding difference to the case where the offset voltage Vos(AY) is zero, is 100–180 volts. Furthermore, considering that the luminance can be improved by 1.5 times, more preferable range of the offset voltage Vos(AY) is 150–180 volts. On the other hand, a preferable range of the offset voltage Vos(XY) for the XY-interelectrode is 80–180 volts, in which both the luminance and the light emission efficiency can be improved. Considering more improvement, more preferable range of the offset voltage Vos(XY) is 120–180 volts.

As explained above, luminance and light emission efficiency can be improved by making the operation during the display period TS be the offset drive. However, when the offset drive causes display discharge having more intensity than the normal drive, discharge impact to a cell is increased. As a result, a display life of the PDP 1 may be shortened. Especially, if a so-called counter discharge is generated between the display electrode X or Y and the opposed address electrode A along with surface discharge between the display electrodes during the sustaining process, the fluorescent material may be deteriorated at high speed. Therefore, when designing drive operation of the drive unit 70, it is required to secure a display life sufficient for practical use. For the design under such a requirement, an analysis method of utilizing the Vt closed curve for the PDP 1 to be driven is useful. In other words, it is efficient to obtain the Vt closed curve, and determine the offset vector on the cell voltage plane.

Figure 11A:
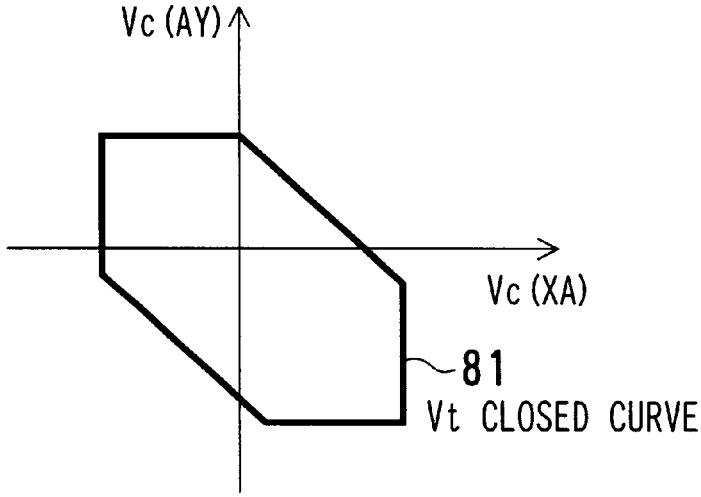
FIGS. 11A–11C are explanatory diagrams of a procedure of operational setting that unitizes a Vt closed curve.
Figure 11B:
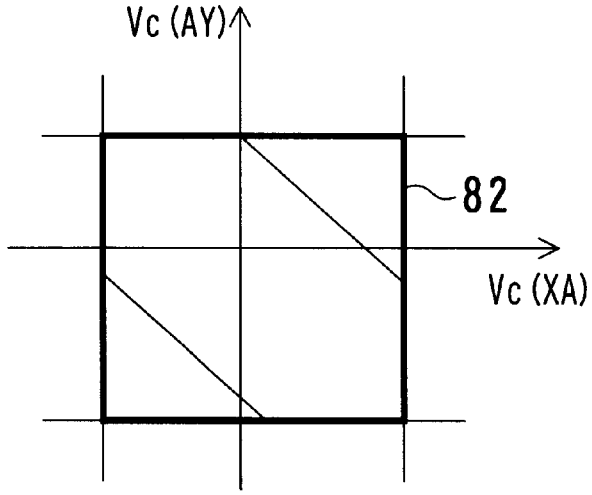
Figure 11C:
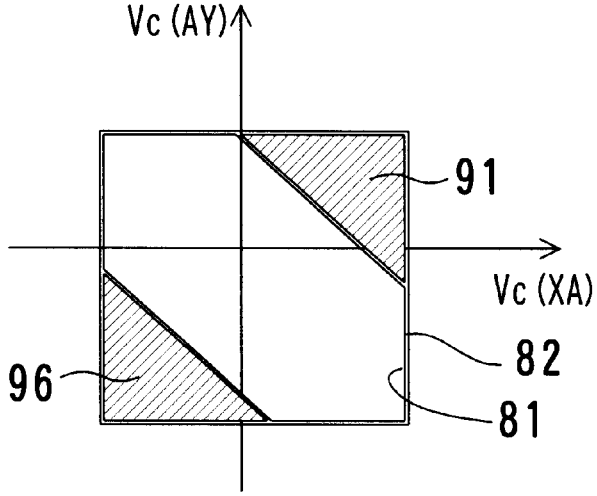

FIGS. 11A–11C are explanatory diagrams of a procedure of operational setting that utilizes a Vt closed curve.

The PDP 1 with a three-electrode structure has the interelectrode of the display electrode X and the display electrode Y (the XY-interelectrode), the interelectrode of the display electrode X and the address electrode A (the XA-interelectrode), and the interelectrode of the address electrode A and the display electrode Y (the AY-interelectrode). If two of these three interelectrodes are analyzed, the relationship among the three interelectrode becomes clear. Here, considering prevention of the counter discharge in which the address electrode A takes part, the XA-interelectrode and the AY-interelectrode are noted. However, other combinations can be selected for the analysis.

As shown in FIG. 11A, a space with coordinates having the horizontal axis of the cell voltage Vc(XA) at the XA-interelectrode and the vertical axis of the cell voltage Vc(AY) at the AY-interelectrode is defined as the cell voltage plane. For each of the three interelectrodes, a microdischarge start voltage that is a cell voltage that can generate microdischarge is measured while cell voltages of other two interelectrodes are switched. The detail is as follows. First, a sufficiently high voltage is applied for generating large discharge, so that wall charge in the cell is self-erased. After making the wall voltage zero in this way, a potential of one electrode is gradually raised while monitoring the light emission by an optical sensor. Potentials of other electrodes are fixed. When raising the voltage sufficiently slowly, microdischarge accompanied with weak light emission continues after the time point when the voltage exceeds a constant voltage. If it is certain large discharge, reform of wall charge causes a large drop of the cell voltage and stop of the discharge. However, if it is microdischarge, the cell voltage drops only slightly, and the cell voltage is recovered promptly when the applied voltage rises. As a result, microdischarge is generated repeatedly during a short period during which light emission continues. The applied voltage when the light emission starts is read for obtaining a set of cell voltages (Vc(XA) and Vc(AY)) when the microdischarge starts. Similar operation is repeated while changing the other electrode potentials step by step. Similar measurement is performed for other electrodes. When the measurement result is plotted on the cell voltage plane, a substantially hexagonal Vt closed curve 81 appears. In such a way that discharge is generated when the potential state in the cell is moved from the inside to the outside of the Vt closed curve 81, the optimal applied voltage can be studied easily including the interaction between cell voltage components by obtaining the Vt closed curve 81.

As shown in FIG. 11B, among six sides that constitute the Vt closed curve 81, four sides indicating the discharge start voltages of the AY-interelectrode and the XA-interelectrode are extended by adding lines so that a substantially rectangular closed curve is drawn. This is an imaginary Vt closed curve 82 that indicates a discharge start condition only for the counter discharge. In order to generate only the surface discharge at the XY-interelectrode and to avoid the counter discharge, the cell voltage just before the discharge should be set in the area that is the inside of the substantially rectangular Vt closed curve 82 (the area without exceeding the threshold level) and that is the outside of the substantially hexagonal Vt closed curve 81, i.e., two triangular areas with hatching (counter discharge avoiding areas) 91 and 96 as shown in FIG. 11C. More preferably, within these areas 91 and 96, the point having the highest light emission efficiency is selected to determine the amplitude of the offset pulse. In this way, the counter discharge is not generated, so that a high efficiency drive with little deterioration of the fluorescent materials can be realized.

The above-explained setting of operation is based on that avoidance of deterioration of the fluorescent materials is essential. However, the counter discharge in the sustaining process is not necessarily required to be prevented completely. There can be an operational setting in which the deterioration of the fluorescent materials is permitted to some extent and instead the light emission efficiency is improved. Also in this setting with priority on the light emission efficiency, the drive waveforms can be determined by utilizing the Vt closed curve as explained below.

Figure 12:
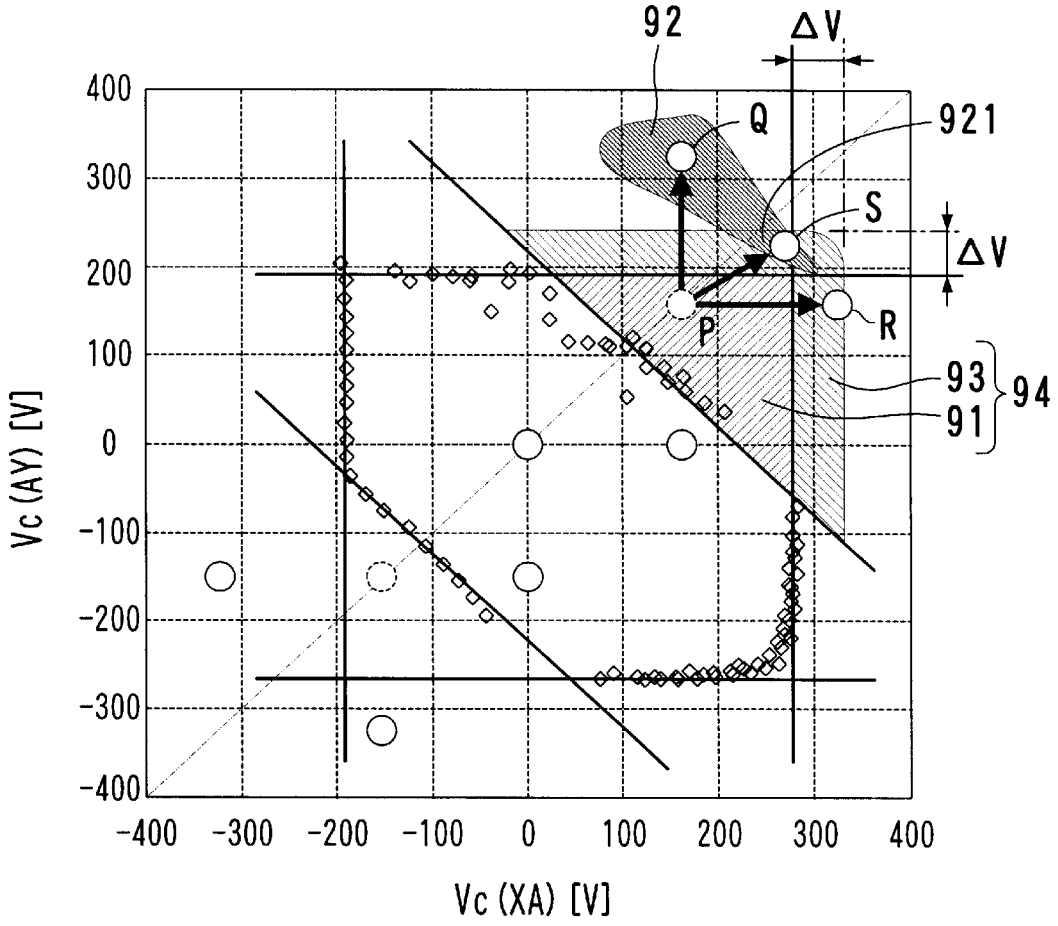
FIG. 12 is a graph showing a concrete example of an offset vector.
Figure 13:
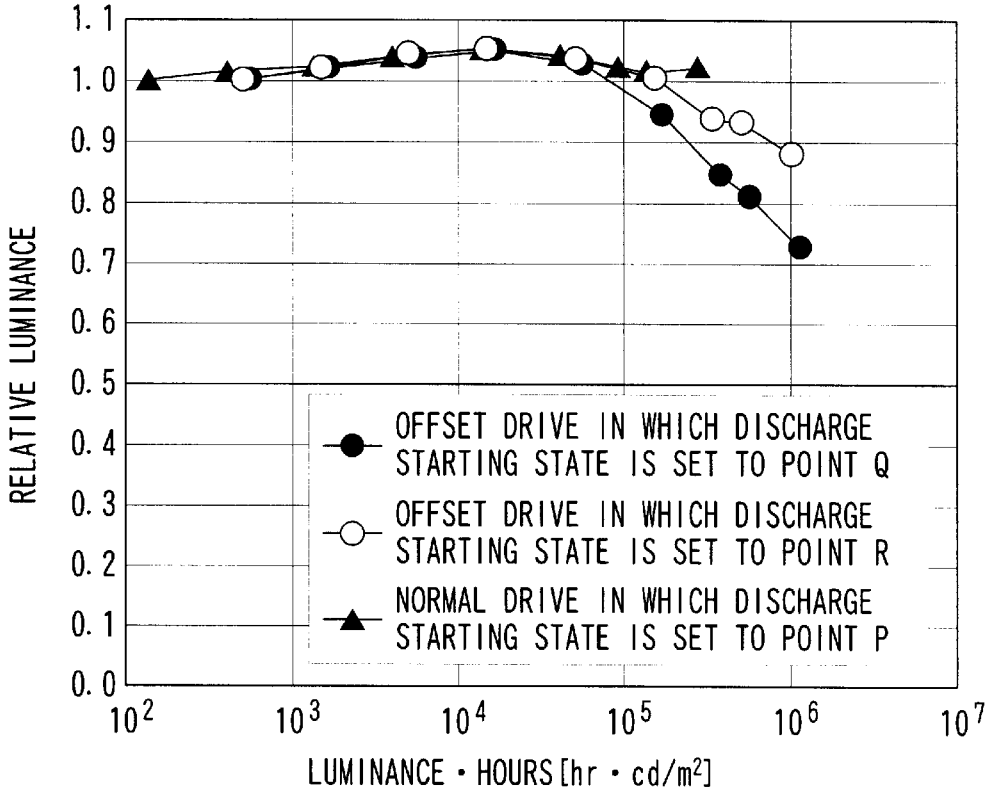
FIG. 13 is a graph showing a result of a life test.

FIG. 12 is a graph showing a concrete example of a offset vector, and FIG. 13 is a graph showing a result of a life test. In FIG. 12, a set of small rhombus marks indicates the measured Vt closed curve. The explanation below is also about the example of display discharge in which the display electrode X works as an anode, and the display electrode Y works as a cathode. The cell state in the normal drive at the start of the display discharge is the point P located on the line that passes the origin and has the slope one. Furthermore, in the offset drive that does not generate the counter discharge as explained above, the cell state at start of the display discharge is set to the position that is located inside the triangular counter discharge avoiding area 91 and is not on the above-mentioned line. In contrast, concerning the setting with a priority on the light emission efficiency, the cell state at the start of the display discharge is not limited to the inside of the counter discharge avoiding area 91. Actually, when trying to realize the highest light emission efficiency on the basis of the data about the light emission efficiency shown in FIG. 10, the cell state at the start of the display discharge will deviate from the counter discharge avoiding area 91. If a condition that relative efficiency is 2.0 or more is placed, the area 92 shown in FIG. 12 will be permitted on the cell voltage plane. However, for suppressing deterioration of the fluorescent materials, the allowance range is limited. FIG. 13 shows the offset drive (dots) for setting the cell state at the start of display discharge to the point Q in the area 92 that is far away from the counter discharge avoiding area 91, the offset drive (circles) for setting the cell state at the start of the display discharge to the point R in the area 93 that has a voltage difference less than 50 volts from the counter discharge avoiding area 91, and the normal drive (black triangles), in the form of variation of luminance along time when the entire screen is lighted continuously. Since luminance of light emission by one time of display discharge depends on the driving method, values of (initial luminance x hours) are adopted for the horizontal axis. Relative luminance values that are normalized with the initial luminance are adopted for the vertical axis.

Since the point Q is deviated from the counter discharge avoiding area 91 by more than 120 volts in the direction along the vertical axis, there is a large drop of the luminance in the offset drive in which the cell state at the start of the display discharge is set to the point Q. In the offset drive in which the cell state at the start of the display discharge is set to the point R, the drop of luminance is small, so that a life is obtained that is the same as in the normal drive. It is considered from the result of this test that even if the cell state is deviated from the counter discharge avoiding area 91, deterioration of the fluorescent materials is within the allowance range by the offset drive in which the cell state at the start of the display discharge is set to the inside of the area that has a voltage difference $\Delta V$ from the counter discharge avoiding area 91 that is 50 volts or less. If the deterioration of the fluorescent materials is suppressed within the allowance range and the relative luminance is set to a value of 2.0 or more, the cell state at the start of the display discharge should be set to the point S in an area 921 that belongs both to the area 93 and to the area 92.

Although the method of utilizing the Vt closed curve as explained above is useful for designing waveforms of the offset drive, it is not limited to the usage in the offset drive. It can be used generally for setting the cell voltage when discharge is generated. The target of drive is not limited to the three-electrode structure. If the cell structure changes, the shape of the Vt closed curve is also changed, and the condition of deterioration in luminance is also changed. By measuring the Vt closed curve regardless of the cell structure, a drive operation can be determined so that a large discharge impact is not given to the element subjected to deterioration such as fluorescent materials or a dielectric layer.

According to the above-mentioned embodiment, since the offset pulse is applied not only to the display electrodes X and Y but also to the address electrodes A, the cell state at start of the display discharge can be moved on the cell voltage plane in any direction. Therefore, a display can be realized that has light emission efficiency higher than the case where the cell state at start of the display discharge is moved only in one direction.

In the above-mentioned embodiment, it is preferable to adopt a current control in which the current supplying path between the drive power source and the display electrode X or Y is set to the high impedance state at a trailing edge of the offset pulse when the display discharge is directed to the end. By this control, current supply from the drive power source to the discharge space is suppressed in display discharge. Instead, discharge current flows from a capacitor that is made of a structure in a cell such as a dielectric layer 17. Since the current path is shortened, a power loss generated in the path is reduced so that the light emission efficiency is improved.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display device comprising;

a three-electrode surface discharge AC type plasma display panel including an electrode matrix made of a display electrode arrangement and an address electrode arrangement;

a driving circuit for driving the plasma display panel;

cells of the plasma display panel having a structure in which a discharge gas space and a fluorescent material are disposed between the display electrode and the address electrode, the fluorescent material emitting light by discharge;

the driving circuit performing drive operation of changing a potential of at least one display electrode in each of the cells so as to be different between a start time point and an end time point of display discharge for generating display discharge and following reform of wall charge in cells to be lighted after an addressing process for forming wall charge in the cells to be lighted, wherein concerning the drive operation, a cell voltage between the display electrode and the address electrode at the start time point of the display discharge is set to a voltage lower than a microdischarge start voltage that is measured in advance.

2. A plasma display device comprising;

a three-electrode surface discharge AC type plasma display panel including an electrode matrix made of a display electrode arrangement and an address electrode arrangement;

a driving circuit for driving the plasma display panel;

cells of the plasma display panel having a structure in which a discharge gas space and a fluorescent material are disposed between the display electrode and the address electrode, the fluorescent material emitting light by discharge;

the driving circuit performing drive operation of changing a potential of at least one display electrode in each of the cells so as to be different between a start time point and an end time point of display discharge for generating display discharge and following reform of wall charge in cells to be lighted after an addressing process for forming wall charge in the cells to be lighted, wherein concerning the drive operation, a cell voltage between the display electrode and the address electrode at the start time point of the display discharge is set to a voltage within a range higher than a microdischarge start voltage that is measured in advance and lower than the microdischarge start voltage plus 50 volts.

3. A method for setting drive operation for a plasma display panel having cells in which three or more electrodes are arranged, the method comprising the steps of;

measuring a microdischarge start voltage that is a cell voltage when microdischarge is generated for each of three interelectrodes of the cell, with changing cell voltages at other two interelectrodes;

determining a closed curve having a substantially hexagonal shape indicating a relationship among the microdischarge start voltages of the three interelectrodes by plotting the result of the measurement on a plane with coordinates having the first axis of the cell voltage of the first interelectrode and the second axis of the cell voltage of the second interelectrode; and setting the cell voltages of the first and the second interelectrodes at a start time point of display discharge to voltages in the area outside the closed curve in the plane with coordinates.

4. The method according to claim 3, further comprising the steps of;

determining a closed curve having a substantially rectangular shape indicating a relationship between the microdischarge start voltages of the first and the second interelectrodes by drawing on the basis of the closed curve having a substantially hexagonal shape; and setting the cell voltages of the first and the second interelectrodes at the start time point of the display discharge to voltages in the area outside the closed curve having a substantially hexagonal shape and inside the closed curve having a substantially rectangular shape.

* * * * *